US008966860B2

(12) United States Patent
Hovenier et al.

(10) Patent No.: US 8,966,860 B2
(45) Date of Patent: Mar. 3, 2015

(54) WALL LIFTING, TRANSPORT AND POSITIONING DEVICE WITH ROLLER PINS

(71) Applicants: Fred E. Hovenier, Corona, CA (US); Fred J. Hovenier, Corona, CA (US)

(72) Inventors: Fred E. Hovenier, Corona, CA (US); Fred J. Hovenier, Corona, CA (US)

( * ) Notice: Subject to any disclaimer, the term of this patent is extended or adjusted under 35 U.S.C. 154(b) by 10 days.

(21) Appl. No.: 13/799,209

(22) Filed: Mar. 13, 2013

(65) Prior Publication Data

US 2013/0269285 A1 Oct. 17, 2013

Related U.S. Application Data

(63) Continuation-in-part of application No. 13/444,080, filed on Apr. 11, 2012, now Pat. No. 8,776,478.

(51) Int. Cl.

| | |
|---|---|
| ***E04H 1/00*** | (2006.01) |
| ***E04H 14/00*** | (2006.01) |
| ***E04G 21/04*** | (2006.01) |
| ***E04G 21/26*** | (2006.01) |
| ***E04G 21/16*** | (2006.01) |

(52) U.S. Cl.

CPC ..... *E04G 21/167* (2013.01)
USPC ..... 52/745.11; 52/79.1; 52/79.9; 52/79.13; 52/127.2; 52/127.8

(58) Field of Classification Search

CPC ..... E04G 21/14; E04G 21/16; E04G 21/165; E04G 21/167; E04G 21/168
USPC ..... 414/10–12; 52/79.1, 79.9, 79.13, 127.2, 52/127.7, 127.8, 745.09, 745.1, 745.12, 52/745.19, 745.2
See application file for complete search history.

(56) References Cited

U.S. PATENT DOCUMENTS

| | | | | |
|---|---|---|---|---|
| 2,785,814 | A | 3/1957 | Corley | |
| 2,828,869 | A | 4/1958 | Corley | |
| 2,828,870 | A * | 4/1958 | Corley | 414/11 |
| 3,782,771 | A | 1/1974 | Moore | |

OTHER PUBLICATIONS

Northstar, Owner's Manual Instructions for Assembly, Testing, Operation, Servicing, & Storage, Manual, 46 pages, Northern Tool + Equipment Co., Inc., Mar. 2009.

* cited by examiner

*Primary Examiner* — Mark Wendell
(74) *Attorney, Agent, or Firm* — Stetina Brunda Garred & Brucker

(57) ABSTRACT

A wall lifting, transport and positioning device for use with a wall section upon a worksite surface. The wall section has a top plate with a lower top plate side and a bottom plate with a lower bottom plate side. The device includes a wheeled hand cart housing, a support frame, a pair of roller pins, and a lifting actuator. Each of the roller pins including an outer cylindrical element configured to rotate relative to the support frame with the top plate being positioned in contact with the outer cylindrical element for translation of the wall section in a direction along the top plate. The lifting actuator is sized and configured to translate the roller pins upward relative to the wheeled hand cart housing with the outer cylindrical elements being positionable in contact with the lower top plate side. A method of positioning a wall section is also provided.

17 Claims, 11 Drawing Sheets

WALL LIFTING, TRANSPORT AND POSITIONING DEVICE WITH ROLLER PINS

CROSS-REFERENCE TO RELATED APPLICATIONS

This application is a continuation-in-part application of U.S. patent application Ser. No. 13/444,080(now U.S. Pat. No. 8,776,478) filed on Apr. 11, 2012 and claims of benefit of such earlier filing date of such parent application the entire contents of which are hereby incorporated by reference.

STATEMENT RE: FEDERALLY SPONSORED RESEARCH/DEVELOPMENT

Not Applicable

BACKGROUND

1. Technical Field

The present disclosure generally relates to devices and methods for positioning pre-fabricated wall sections, and more particularly, to a wall lifting, transport and positioning device for use with a wall section upon a worksite surface.

2. Related Art

Prefabricated wall panels or wall sections have continued to gain increased popularity due to the relative efficiency in the onsite construction of a structure. These pre-fabricated or pre-engineered wall sections are constructed offsite and delivered to a worksite location ready to be erected. This saves significant onsite construction time and labor to build a similar wall section which then must be erected. The wall sections are delivered to worksite location and may be temporarily stored in horizontal stacked configuration. A wall section may typically come is 8'-12' lengths with heights of 8'-12' depending upon a desired ceiling height. The various components of a wall section may be formed of 2" by 4" or 2" by 6" cross sections of lumber. The wall sections each include a horizontal top plate, a horizontal bottom plate and a plurality of vertical studs extending between the top and bottom plates at spaced intervals. The wall sections are also referred to as stud framed walls. This classic arrangement is configured to withstand in-plane shear loading of the associated structure. As such the wall sections are also referred to as shear walls.

The bottom plate is set generally upon a subfloor or foundation. The bottom plate has bolt holes form through them. Inset in the subfloor or foundation are corresponding anchor bolts that are configured to engage the wall sections through the bolt holes for securely anchoring the wall sections to the subfloor or foundation. A foundation U-channel or track is disposed upon the subfloor or foundation that extends the length of the bottom plate. The anchor bolts extend upwards through holes in the foundation U-channel. When erecting the wall section in a vertical configuration, the entire wall section must be lifted vertically above the foundation U-channel and the anchor bolts. The bolt holes must be precisely aligned with the anchor bolts and then the entire wall section is lowered into the foundation U-channel with the bolts extending through the bolt holes.

The proper installation of a wall section is a labor intensive and time consuming process. A large number of workers are required to erect, position and install a wall section due to its physical weight and geometry. This contemplated to interrupt workers who must stop their tasks at the worksite to help with the wall section. Moreover, this installation process presents significant safety issues as well.

The first step in the installation process is that the wall section must be physically lifted and moved adjacent the installation location. The bottom plate is aligned along the foundation U-channel. Next, the wall section must be tilted up to a vertical position, and then dead-lifted upward and translated over the foundation U-channel. The entire wall section must be precisely positioned to align the bolt holes with the anchor bolts extending through the foundation U-channel. All the while, the entire wall section is being physically held. Finally, the wall section is lowered in place with the bolts engaged with the bolt holes.

Accordingly, there is a need in the art for an improved device and method of lifting, transporting and/or positioning wall sections.

BRIEF SUMMARY

According to an aspect of the invention, there is provided a wall lifting, transport and positioning device for use with a wall section upon a worksite surface. The wall section is rectangular and has a horizontal top plate and an opposing horizontal bottom plate. The top plate has a lower top plate side facing towards the bottom plate. The bottom plate has a lower bottom plate side facing away from the top plate. The lower top plate side and the lower bottom plate side define a lifting wall height there between. The device includes a wheeled hand cart housing, a support frame, a pair of roller pins, and a lifting actuator. The roller pins extend from the support frame away from the wheeled hand cart housing. The roller pins are horizontally aligned and positionable at least the lifting wall height above the worksite surface. Each of the roller pins include an outer cylindrical element configured to rotate relative to the support frame with the lower top plate side being positioned in contact with the outer cylindrical element for translation of the wall section in a direction along the top plate. The lifting actuator is disposed between the wheeled hand cart housing and the support frame. The lifting actuator is sized and configured to translate the roller pins upward relative to the wheeled hand cart housing with the outer cylindrical elements being positionable under and in contact with the lower top plate side. It is contemplated that the roller pins are particularly advantageous in that they allow for an ease of positioning of the support wall section. This is particularly important as this allows for proper alignment and positioning of the wall section during its installation process. Furthermore, it is contemplated that such process may be safely accomplished with a minimal amount of physical labor and number of workers involved.

According to various embodiments, the lifting actuator and the support frame may be cooperatively sized and configured to translate the roller pins upward relative to the wheeled hand cart housing with the outer cylindrical elements being positionable under and in contact with the lower top plate side and the wall section being laterally supported by support frame. The support frame may be generally planar. The support frame may be disposed at an angle with respect to the vertical plane with the cart disposed upon the worksite surface. The support frame may be generally disposed at an angel generally between 5 degrees and 20 degrees, such as at approximately 8 degrees with respect to the vertical plane with the cart disposed upon the worksite surface.

The lifting actuator may be a hydraulic device. The lifting actuator may include a cylinder that is configured to move relative to the wheeled hand cart housing. The roller pins may be removeably attached to the support frame. The roller pins may be attachable at varying heights along the support frame. The device further may include a counter-weight disposed upon the wheeled hand cart housing. The device may further include a pair of main wheels mounted to the wheeled hand cart housing. The device may further include a steerable wheel mounted to the wheeled hand cart housing. The wheeled hand cart housing may include a housing frame and a main support base, and the lifting actuator may be disposed between the main support base and the support frame. The wheeled hand cart housing may further include a support base disposed between and connected to the housing frame and the main support base, and the support brace may be disposed away from the support frame in a plane generally perpendicular to a plane of the support frame. The wheeled hand cart housing may further include a pair of wing braces disposed between and connected to the housing frame and the main support base, and the wing braces may respectively extend laterally from the main support base.

According to another aspect of the invention, there is provided a method of positioning a wall section within a foundation U-channel. The wall section is rectangular and has a horizontal top plate and an opposing horizontal bottom plate. The top plate has a lower top plate side facing towards the bottom plate, and the bottom plate has a lower bottom plate side facing away from the top plate. The method includes moving a wall lifting, transport and positioning device upon a worksite surface adjacent the wall section. The wall section is disposed in a horizontal position. The device includes a wheeled hand cart housing, a support frame, a pair of roller pins extending from the support frame away from the wheeled hand cart housing, and a lifting actuator disposed between the wheeled hand cart housing and the support frame. The lifting actuator is sized and configured to translate the roller pins upward relative to the wheeled hand cart housing. The method further includes tilting the wall section to position the lower top plate side above the pair of roller pins. The method further includes lifting the wall section off of the worksite surface by actuating the lifting actuator. The method further includes moving the device along the worksite surface to position the bottom plate above and along the foundation U-channel. The method further includes translating the wall section with the lower top plate side rolling along the roller pins. The method further includes lowering the wall section with the bottom plate disposed in the foundation U-channel by actuating the lifting actuator.

According to various embodiments, the method may further include lifting the top plate to move the wall section from the horizontal position to a vertical position with the bottom plate disposed adjacent a worksite surface and the top plate disposed above with bottom plate. The foundation U-channel may have a side wall defining a side wall height, and the method may further include lifting the wall section off of the worksite surface at least the side wall height.

The bottom plate may include a plurality of anchor bolt holes and the a plurality of anchor bolts vertically extend from within the foundation U-channel, and the method may further include aligning the anchor bolt holes with anchor bolts. The method may further include lowering the wall section with the anchor bolts extending into the anchor bolt holes. The method may further include a step of tilting the wall section to a vertical position by lifting the top plate off of the roller pins with the bottom plate remaining disposed in the foundation U-channel.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

This application is a continuation-in-part application of U.S. patent application Ser. No. 13/444,080 (the entire contents of which are hereby incorporated by reference) filed on Apr. 11, 2012 and claims of benefit of such earlier filing date of such parent application. The detailed description set forth below in connection with the appended drawings is intended as a description of the presently preferred embodiments of the invention, and is not intended to represent the only form in which the present devices may be developed or utilized. It is to be understood, however, that the same or equivalent functions may be accomplished by different embodiments that are also intended to be encompassed within the spirit and scope of the invention. It is further understood that the use of relational terms such as first, second, and the like are used solely to distinguish one from another entity without necessarily requiring or implying any actual such relationship or order between such entities.

Figure 1:
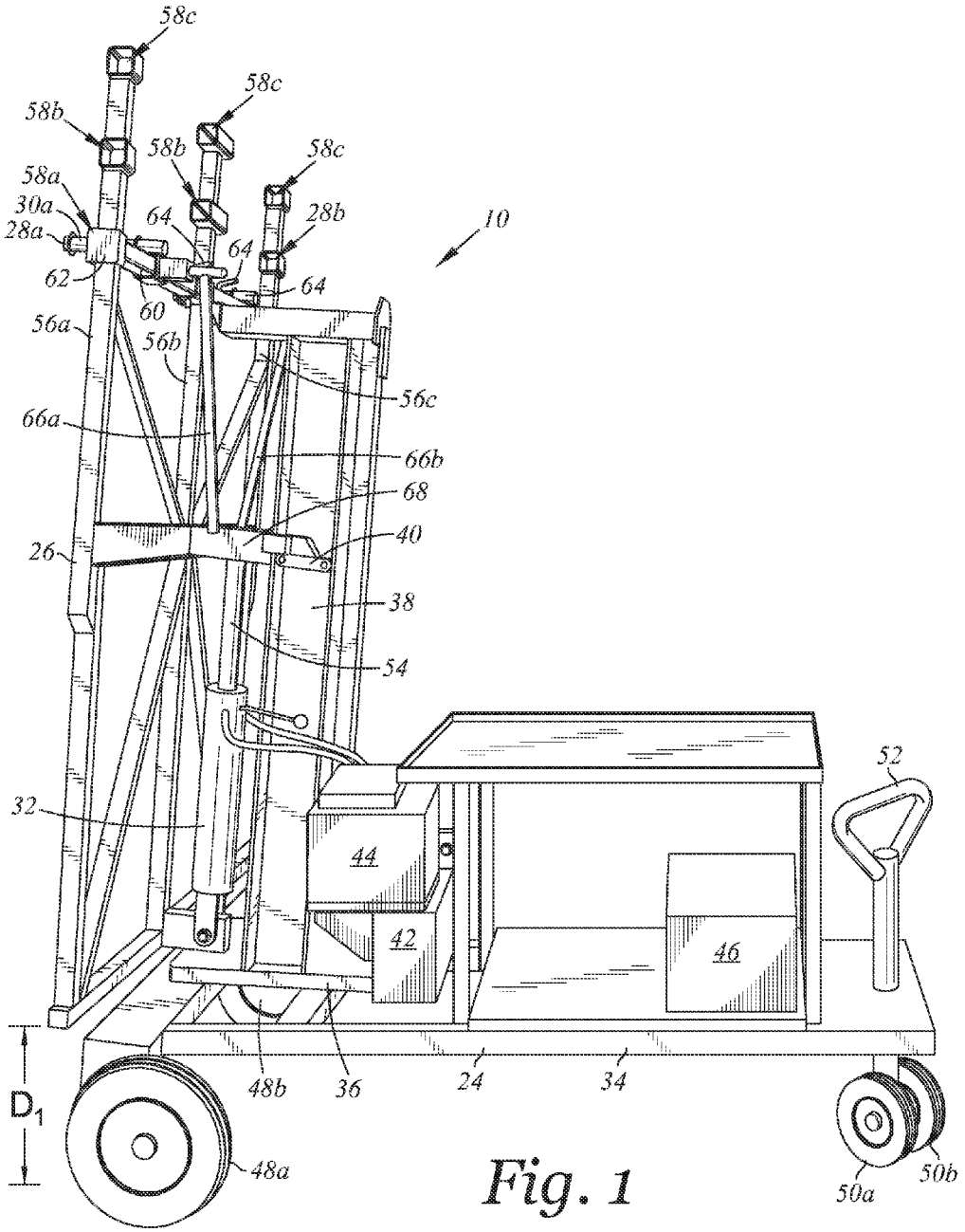
FIG. 1 is a side perspective view of a wall lifting, transport and positioning device having a support frame in a first position according to an aspect of the invention.
Figure 2:
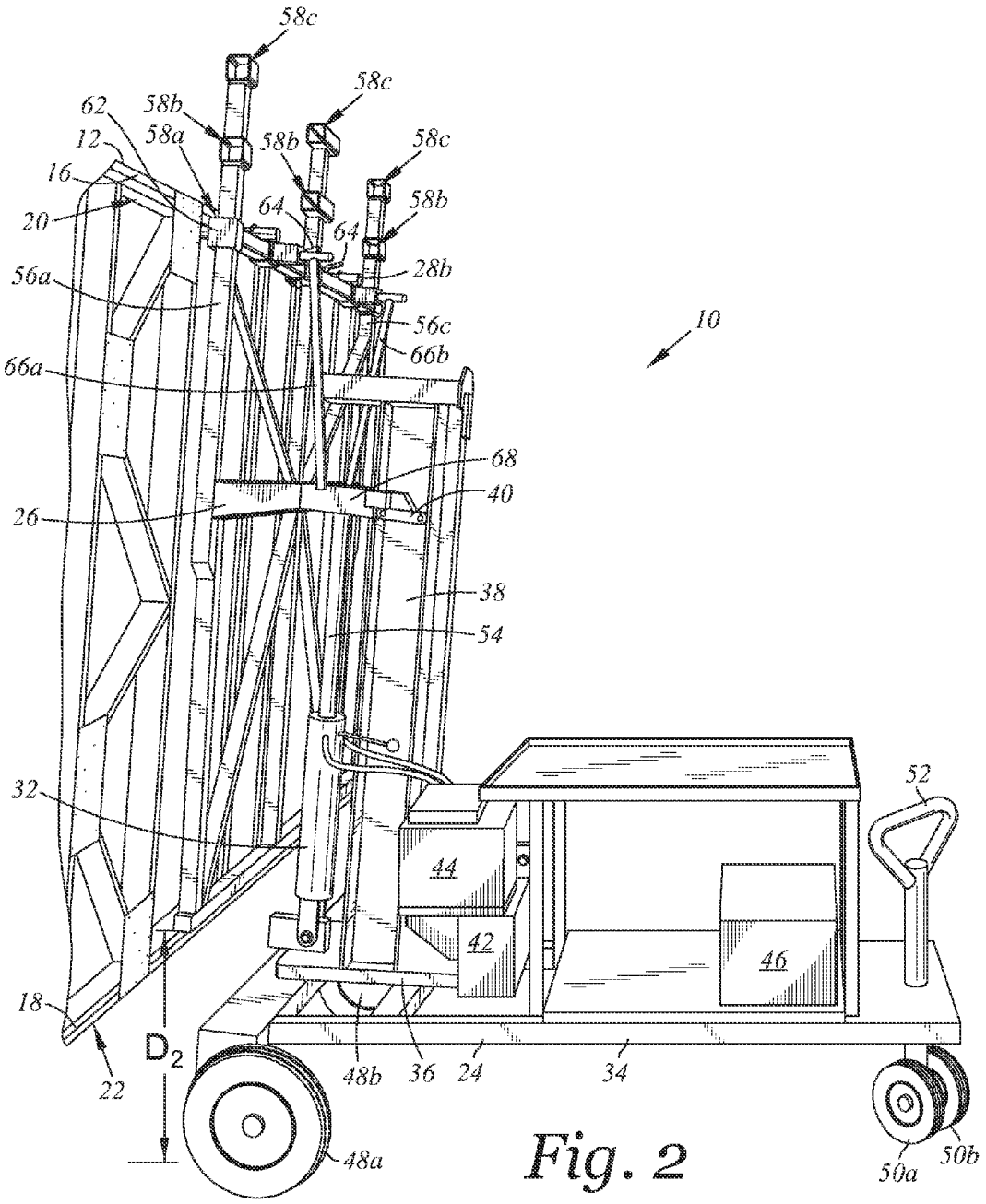
FIG. 2 is a side perspective view of the device of FIG. 1 and a wall section supported by roller pins with the support frame in a second position.
Figure 3:
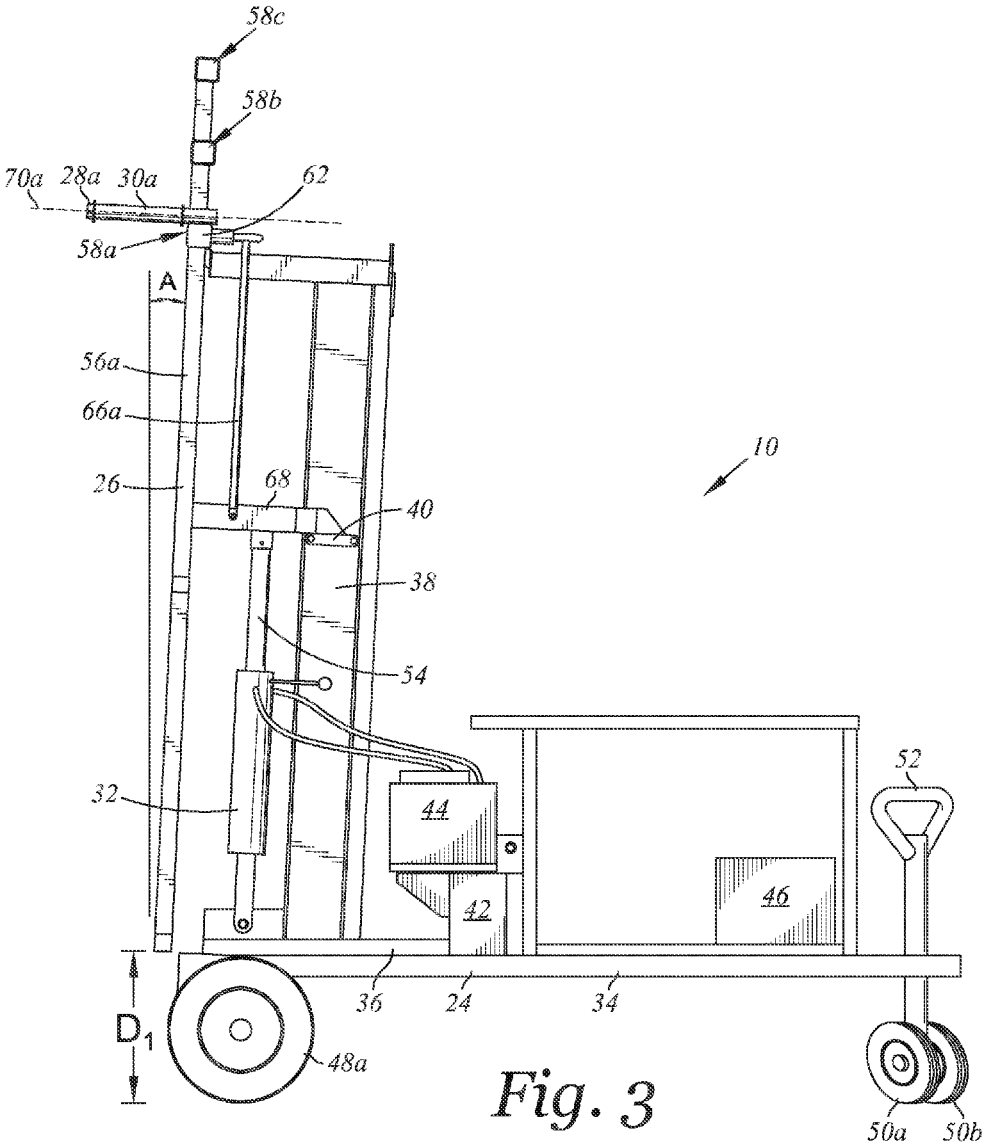
FIG. 3 is a side view of the device of FIG. 1.
Figure 10:
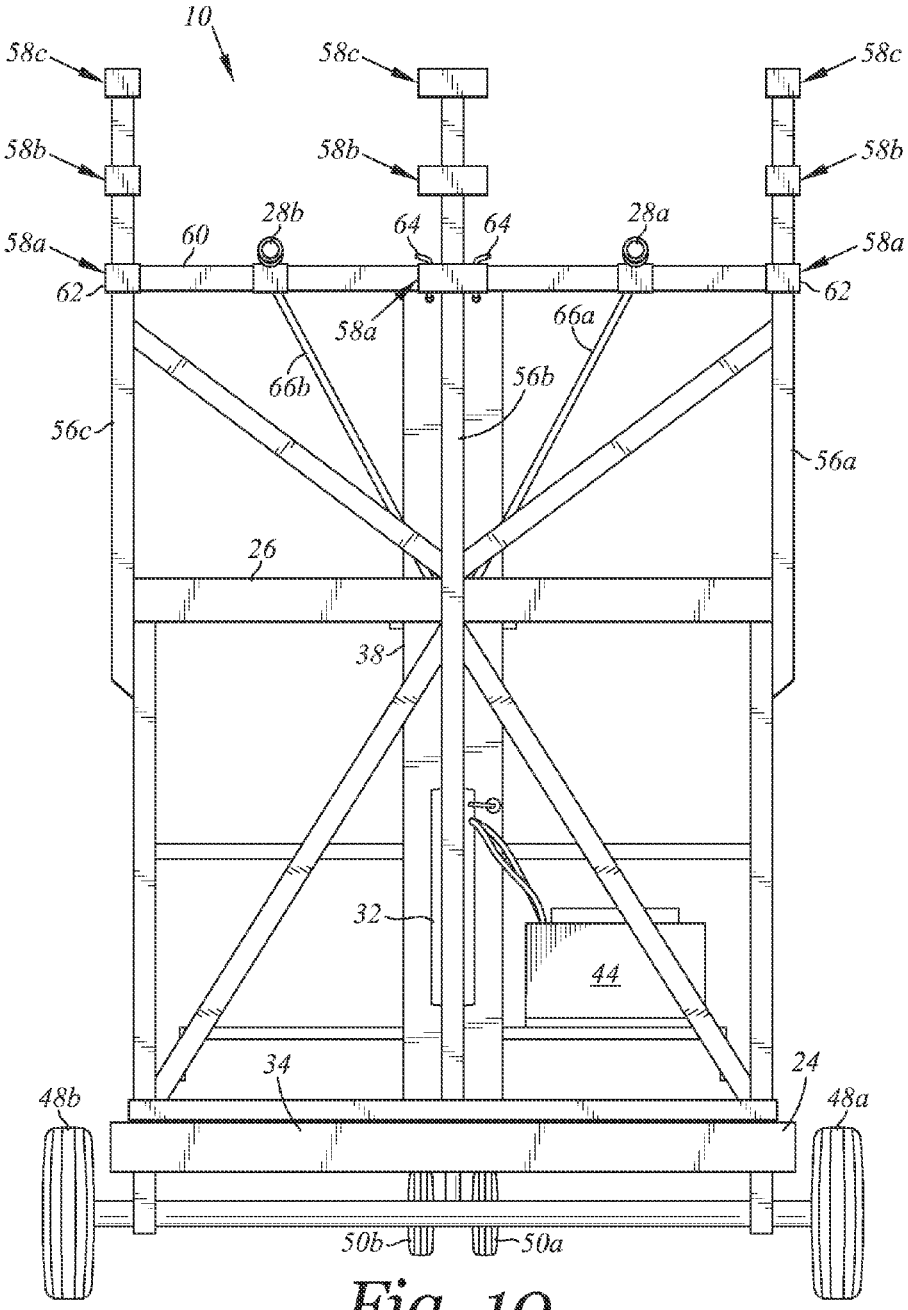
FIG. 10 is an end view of the device of FIG. 1.
Figure 11:
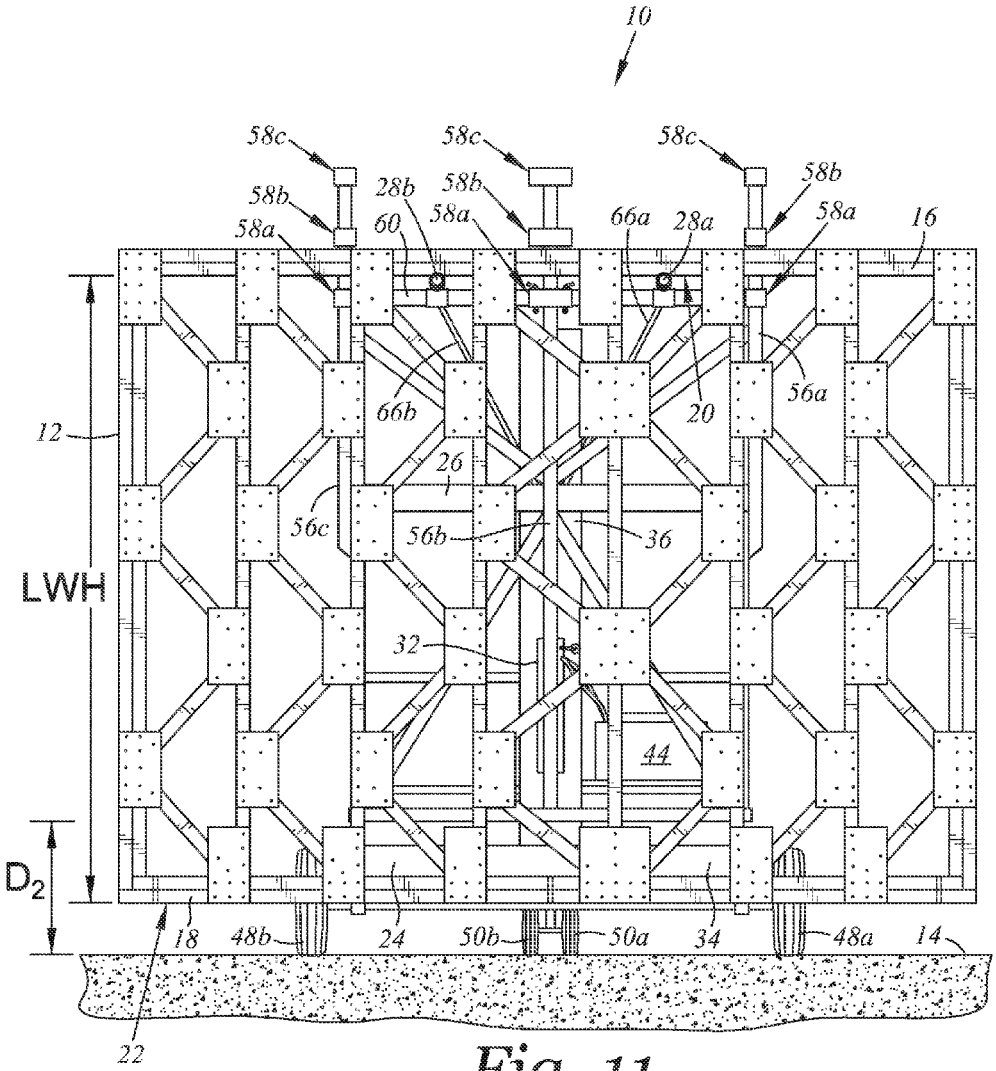
FIG. 11 is an end view of the device of FIG. 2 with the wall section supported by roller pins with the support frame in a second position

Referring now to FIG. 1 there is depicted a side perspective view of a wall lifting, transport and positioning device 10. FIG. 2 is a side perspective view of the device 10 of FIG. 1 with a wall section 12. FIG. 3 is a side view of the device 10 of FIG. 1. FIG. 10 is an end view of the device 10 of FIG. 1. FIG. 11 is an end view of the device 10 of FIG. 2 with the wall section 12 with the device 10 upon a worksite surface 14.

According to an aspect of the invention, there is provided the wall lifting, transport and positioning device 10 for use with the wall section 12 upon a worksite surface 14. The wall section 14 is rectangular and has a horizontal top plate 16 and an opposing horizontal bottom plate 18. The top plate 16 has a lower top plate side 20 facing towards the bottom plate 18. The bottom plate 18 has a lower bottom plate side 22 facing away from the top plate 16. The lower top plate side 16 and the lower bottom plate side 20 define a lifting wall height there between (denoted "LWH" on FIG. 11).

The device 10 includes a wheeled hand cart housing 24, a support frame 26, a pair of roller pins 28*a,b* extending from the support frame 26 away from the wheeled hand cart housing 24, and a lifting actuator 32 disposed between the wheeled hand cart housing 24 and the support frame 26. The roller pins 28*a,b* are horizontally aligned. The roller pins 28*a,b* are positionable at least the lifting wall height (LWH) above the worksite surface 14. Each of the roller pins 28*a,b* include an outer cylindrical element (respectively denoted 30*a,b*) configured to rotate relative to the support frame 26 with the lower top plate side 20 being positioned in contact with the outer cylindrical element 30*a,b* for translation of the wall section 12 in a direction along the top plate 16. The lifting actuator 32 is sized and configured to translate the roller pins 28*a,b* upward relative to the wheeled hand cart housing 24 with the outer cylindrical elements 30*a,b* being positionable under and in contact with the lower top plate side 20. It is contemplated that the roller pins 28*a,b* are particularly advantageous in that they allow for an ease of positioning of a support wall section 12. This is particularly important as this allows for proper alignment and positioning of the wall section 12 during its installation process. Furthermore, it is contemplated that such process may be safely accomplished with a minimal amount of physical labor and number of workers involved.

As used herein the top plate 16 generally refers to a horizontal structural member of the wall section 12 that is adjacent an upper portion of the wall section 12 when the wall section 12 is in an installed vertical position. The top plate 16 may be composed of one or several elements, such as several stacked 2"×4". As used herein the lower top plate side 20 refers to the horizontal surface of the top plate 16 that is engageable by the roller pins 28*a,b*.

In further detail, the wheeled hand cart housing 24 may include a housing frame 34. A main support 38 may extend from the housing frame 34. A main support base 36 may be attached to the housing frame 34 proximate an end of the housing frame 34. In this embodiment, the main support 36 is the primary structure to which the support frame 26 is itself supported. The main support 38 may take the form of an I-beam. The support frame 26 may take advantage of this geometry and utilize a roller configuration to engage an interior of the I-beam shaped main support 38 through the use of a roller assembly 40. In the perspective side view of FIG. 1, the roller assembly 40 is depicted as being engaged with the main support 38. It is understood that another similarly configured roller assembly 40 is likewise engaged with the main support 38 from the opposite side (not visible in this side's view). The lifting actuator 32 is disposed proximate the main support 36 at an end of the housing frame 34. In this regard, also located adjacent thereto is a hydraulic tank 42 and control unit 44 of the lifting actuator 32 which are configured to actuate the lifting actuator 32. The device 10 further may include a counter-weight 46 disposed upon the wheeled hand cart housing 24. In this embodiment, the counter-weight 46 is disposed upon the housing frame 34 at an opposite end of the location of the main support 38, the hydraulic tank 42 and the control unit 44. It is contemplated that the support frame 26 is supported by the main support 38 as well as any supported wall section 12. In this regard, the counter-weight 46 is used for stability by redistributing the center of gravity of the overall device 10 with a wall section 12.

The device may further include a pair of main wheels 48*a,b* mounted to the wheeled hand cart housing 24. The main wheels 48*a,b* are attached to the housing frame 34 at a same end as the main support 36 proximate the "loading" end of the device 10. The device 10 may further include a steerable wheel, such as the pair of steer wheels 50*a,b* mounted to the wheeled hand cart housing 24. The steer wheels 50*a,b* are attached to the housing frame 34 opposite the main wheels 48*a,b*. A steering handle 52 is attached to the steer wheels 50*a,b* and configured to pivot the steer wheels 48*a,b* for steering movement of the device 10.

The lifting actuator 32 may take the form of any number of devices, and any number of off-the-shelf devices may be used that satisfy force, size, cost, mobility and weight requirements. For example, the lifting actuator 32 may be a hydraulic device that may be modified for use in this particular application, such as a log splitter model M1108M.1 manufactured by Northern Tool+Equipment Co., Inc. of Burnsville, MN, for example. Other devices may include pneumatic, gear rack and screw-drive devices as well. The lifting actuator 32 may include a cylinder 54 that is configured to move relative to the wheeled hand cart housing 24. As such, the cylinder 54 may be a piston that is reciprocally translated which in turn is mechanically connected to the support frame 26 for ultimately effecting vertical movement of a supported wall section 12. The lifting actuator 32 may be chosen from any of those devices which are well known to one of ordinary skill in the art.

The lifting actuator and the support frame 26 may be cooperatively sized and configured to translate the roller pins 28*a,b* upward relative to the wheeled hand cart housing 26 with the outer cylindrical elements 30*a,b* being positionable under and in contact with the lower top plate side 20 and the wall section 12 being laterally supported by support frame 26. In the embodiment depicted, the support frame 26 is generally planar. In this regard, the support frame 26 is contemplated to laterally support the wall section 12 through a generally distributed contact therewith. As will be discussed further below, the support frame 26 may be disposed at an angle (denoted angle "A" on FIG. 3) with respect to the vertical plane with the cart housing 24 disposed upon the worksite surface 14. The support frame 26 may be generally disposed at an angel generally between 5 degrees and 20 degrees, such as at approximately 8 degrees with respect to the vertical plane with the cart housing 24 disposed upon the worksite surface 12. It is contemplated that while the support frame 26 in the embodiment depicted includes various members in a truss-like configuration, the support frame 26 need only provide physical support of the roller pins 28*a,b* and a mechanical means for effecting the translation of force from the lifting actuator 32 to the roller pins 28*a,b*.

The support frame 26 may include vertical supports 56*a-c*. Each of the vertical supports 56*a-c* includes crossbar attachment openings 58*a-c* along the vertical supports 56*a-c*. The crossbar attachment openings 58*a-c* are used to engage a main crossbar 60. In the embodiment depicted, the main crossbar 60 is engaged with the crossbar attachment openings 58*a* of the vertical support 56*a-c*. The crossbar attachment openings 58*a-c* correspond to varying positions or heights of the main crossbar 60. In this regard, the crossbar attachment openings 58*a-c* may cooperatively sized and configured to correspond to various wall sections (such as for standard wall sections used in the construction of 9', 10' and 11' ceilings for examples). As such, the roller pins 28 may be attachable at varying heights along the support frame 26. End caps 62 may be removeably affixed to opposing ends of the main cross bar 60. Locking pins 64 may be used to engage the main crossbar 60 with the vertical support 56*b* at a selected one of the crossbar attachment openings 58*a-c* (depicted as being at the crossbar attachment opening 58*a*). The support frame 26 may further include the main cross bar 60 that is sized and configured to rotateably support the roller pins 28*a,b*. The roller pins 28*a,b* may be removeably attached to the support frame 26 at the pin supports 64*a,b*. The roller pins 28*a,b* are each configured to rotate about an axis 70. Each of the roller pins 28*a,b* may include a shaft with the outer cylindrical elements 30*a,b* disposed about each shaft. A bearing assembly may be used to facilitate ease of rotation of the outer cylindrical elements 30*a,b*. The roller pins 28*a,b* may be chosen from those which are well known to one of ordinary skill in the art. Each shaft may be configured to be removable fixed to the support frame 24, such as at the main cross bar 60. Though not depicted locking pins may be used to secure the roller pins 28*a,b* for example. The support frame 26 may further include support arms 66*a,b*. The support arms 66*a,b* mechanically span between the main cross bar 60 and each roller assembly 40.

It is contemplated that the device 10 may be utilized for the construction of wall sections not only on a bottom floor of a building structure but with other floors. In this regard, because the device 10 is relatively compact or light weight in comparison to vehicle and motorized construction equipment, the device 10 may be lifted via a fork lift and placed upon an immediate upper floor.

Figure 4:
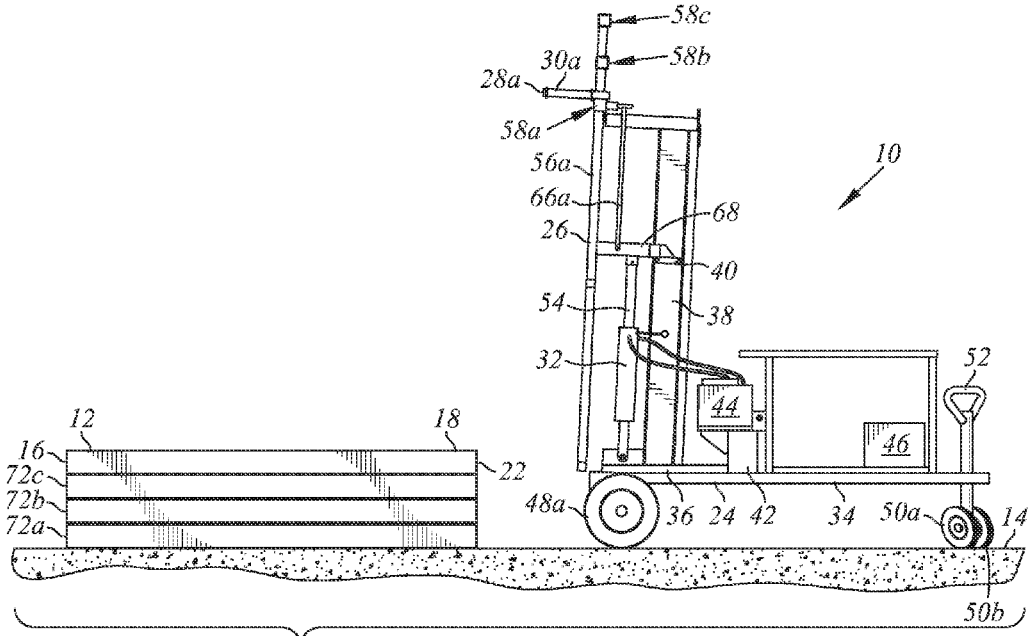
FIG. 4 is the side view of the device of FIG. 3 as shown with a stack of four wall sections.

With the foregoing general device configurations having been described above, further understanding of the particular advantages of aspects of the invention may be best understood with a discussion of how the device 10 may be utilized. Referring now to FIG. 4 there is depicted the side view of the device of FIG. 3 as shown with the wall section 12 and additional wall sections 72*a-c* all arranged in a horizontal stack upon the worksite surface 14. A foundation U-channel 74 (such as is depicted in the side view of FIG. 8 discussed further below) may be provided that is positioned at desired location for the installation of the wall section 12 upon the worksite surface 14.

Figure 5:
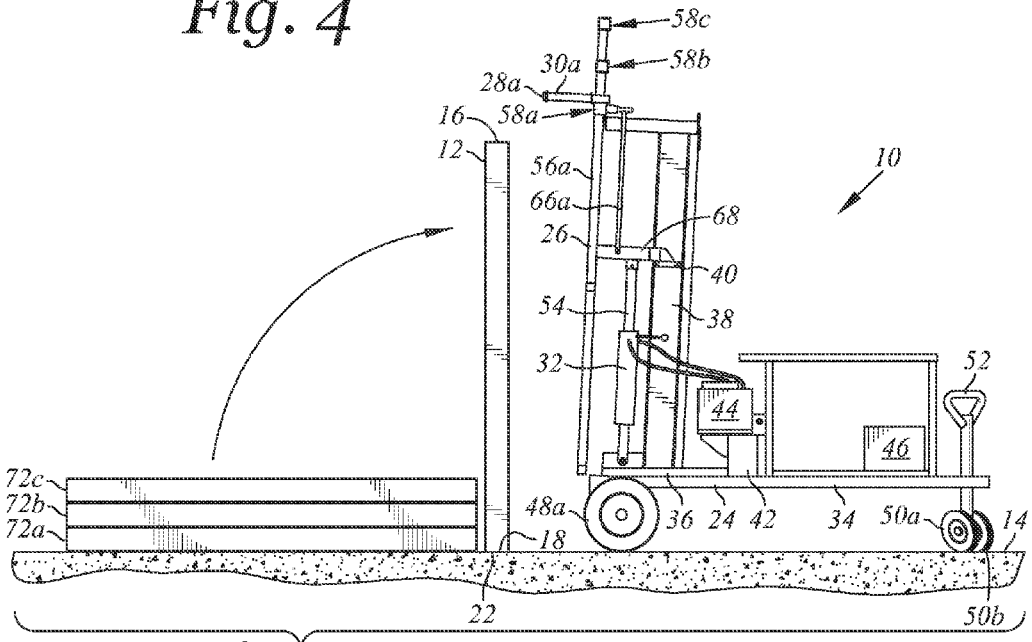
FIG. 5 is the side view of the device of FIG. 4 with a selected one of the wall section in an upright position.
Figure 6:
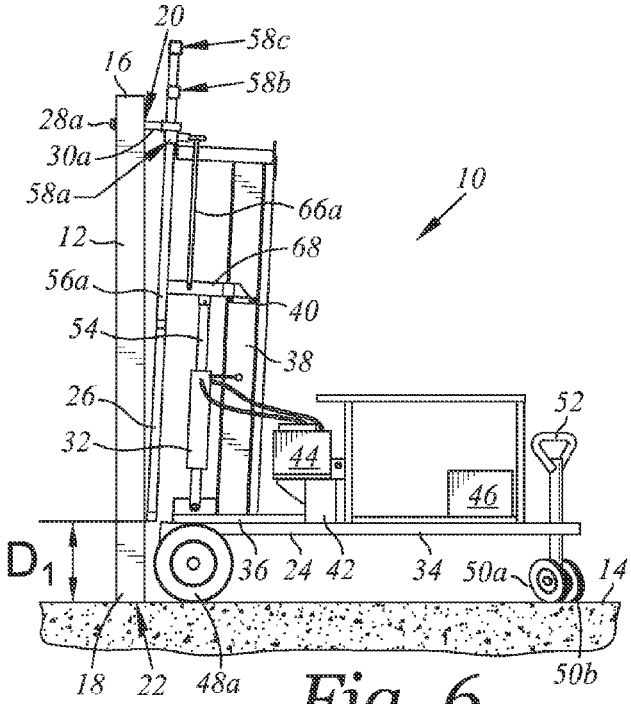
FIG. 6 is the side view of the device of FIG. 5 with the roller pins positioned under a portion of the wall section.

According to an aspect of the invention, there is provided a method of positioning the wall section 12 within the foundation U-channel 74. The method includes moving the wall lifting, transport and positioning device 10 upon a worksite surface 14 adjacent the wall section 12. The method continues with the tilting the wall section to position the lower top plate side above the pair of roller pins as depicted in FIG. 6. The wall section 12 may be tilted to a vertical position with the top plate 16 above the bottom plate 18. The device may be maneuvered adjacent the now vertical wall section 12 such as is depicted in FIG. 5. The support frame 26 may be adjusted downward to a first position such as depicted in FIGS. 1, 3 and 6. The lower most portion of the support frame 26 is at a distance D1 above the worksite surface 14. The method may include lifting the top plate 16 to move the wall section 12 from the horizontal position to the vertical position with the bottom plate 18 disposed adjacent the worksite surface 14 and the top plate 16 disposed above with bottom plate 18. The roller pins 28*a,b* may be positioned below the top plate 16.

Figure 7:
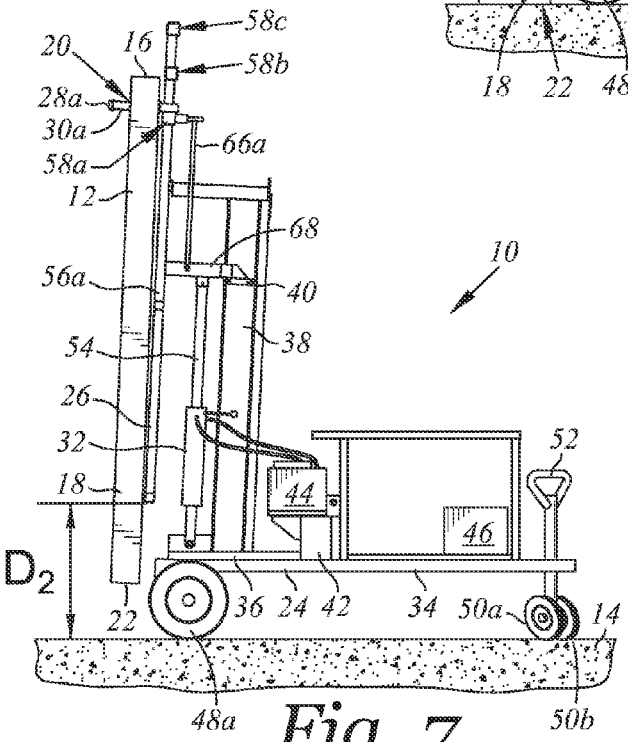
FIG. 7 is the side view of the device of FIG. 6 with the wall section supported by roller pins with the support frame in the second position.

Referring now to FIG. 7 is the side view of the device 10 of FIG. 6 with the wall section 12 supported by roller pins 28*a,b* with the support frame 26 in the second position. FIG. 11 is the corresponding view of the device 10 and the wall section 12 from an end view of the device 10. The lower most portion of the support frame 26 is at a distance D2 above the worksite surface 14. The method further includes lifting the wall section 12 off of the worksite surface 14 by actuating the lifting actuator 32. This results in the support frame 26 moving to the second position.

Figure 8:
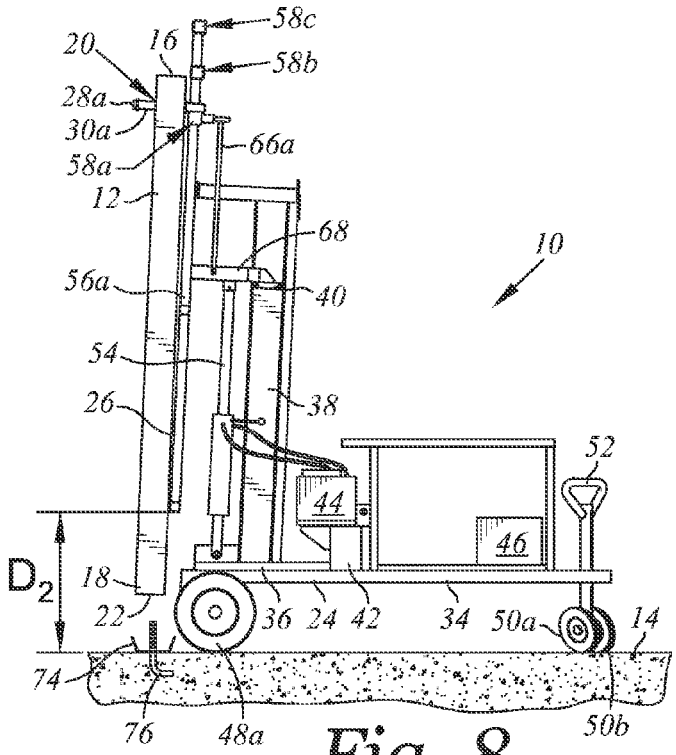
FIG. 8 is the side view of the device of FIG. 7 with the wall section positioned above a foundation U-channel with anchor bolts.
Figure 12:
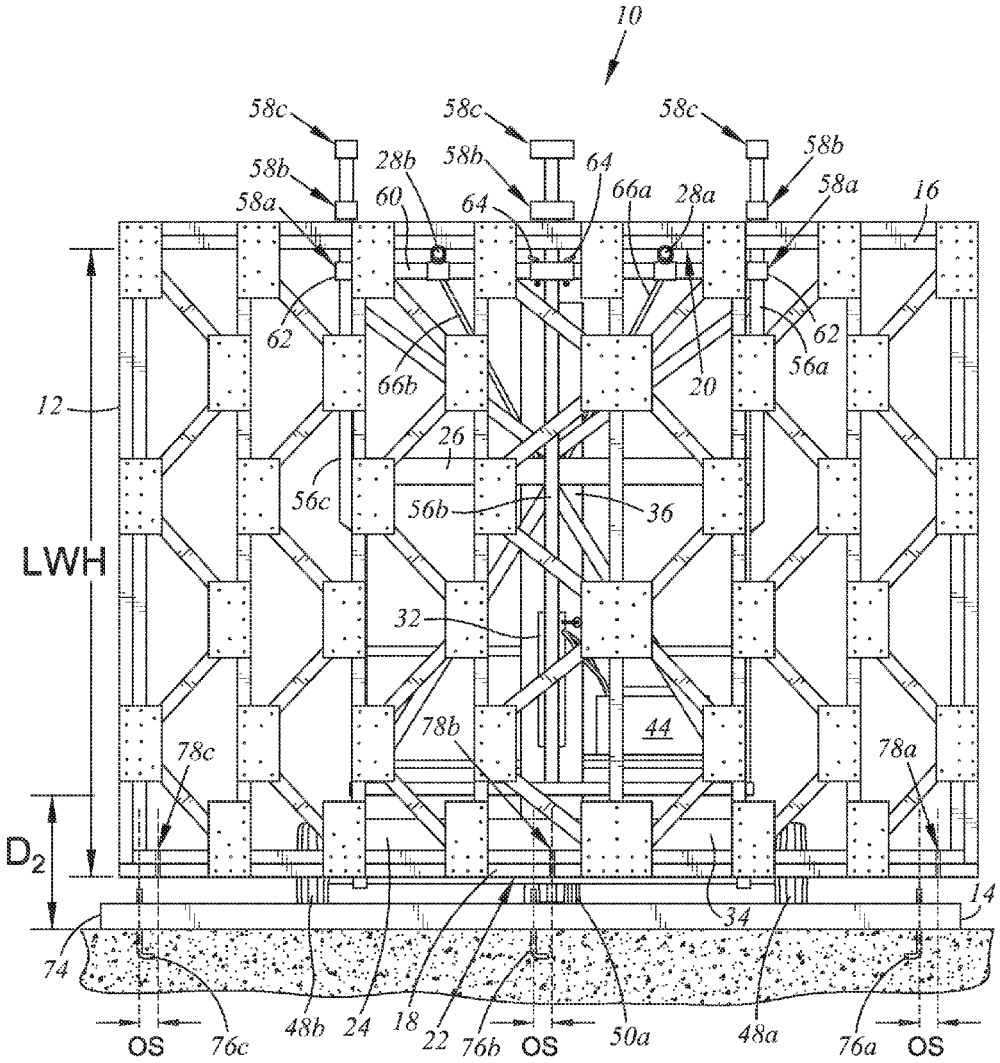
FIG. 12 is an end view of the device of FIG. 8 with the wall section positioned above the foundation U-channel with bolt holes of the wall section laterally offset from the anchor bolts.

Referring now to FIG. 8 is the side view of the device 10 of FIG. 7 with the wall section 12 positioned above the foundation U-channel 74. The foundation U-channel 74 has a U-shaped cross section. Referring additionally to FIG. 12 is an end view of the device 10 of FIG. 8 with the wall section 12 positioned above the foundation U-channel 74. The foundation U-channel 74 may extend the length of the wall section 12. The method further includes moving the device 10 along the worksite surface 14 to position the bottom plate 18 above and along the foundation U-channel 74. The foundation U-channel 74 may have a side wall defining a side wall height, and the method may include lifting the wall section 12 off of the worksite surface 14 at least the side wall height.

Anchor bolts (such as anchor bolts 76*a-c*) are distributed along the foundation U-channel 74. The anchor bolts 76*a-c* may be set within a concrete foundation and extend through the worksite surface 14. The anchor bolts 76*a-c* may take the form of J-bolts. The foundation U-channel 74 may have holes that are configured to receive the anchor bolts 76*a-c* there though. The anchor bolts extend upward and are used to securely fasten the wall section 12 against an inner track of the foundation U-channel 74 and to the worksite surface 14.

Referring now to FIG. 12 is an end view of the device 10 of FIG. 8 with the wall section 12 positioned above the foundation U-channel 74 with bolt holes 78*a-c* of the wall section 12. The bolt holes 78*a-c* are laterally offset from the anchor bolts 76*a-c*.

Figure 13:
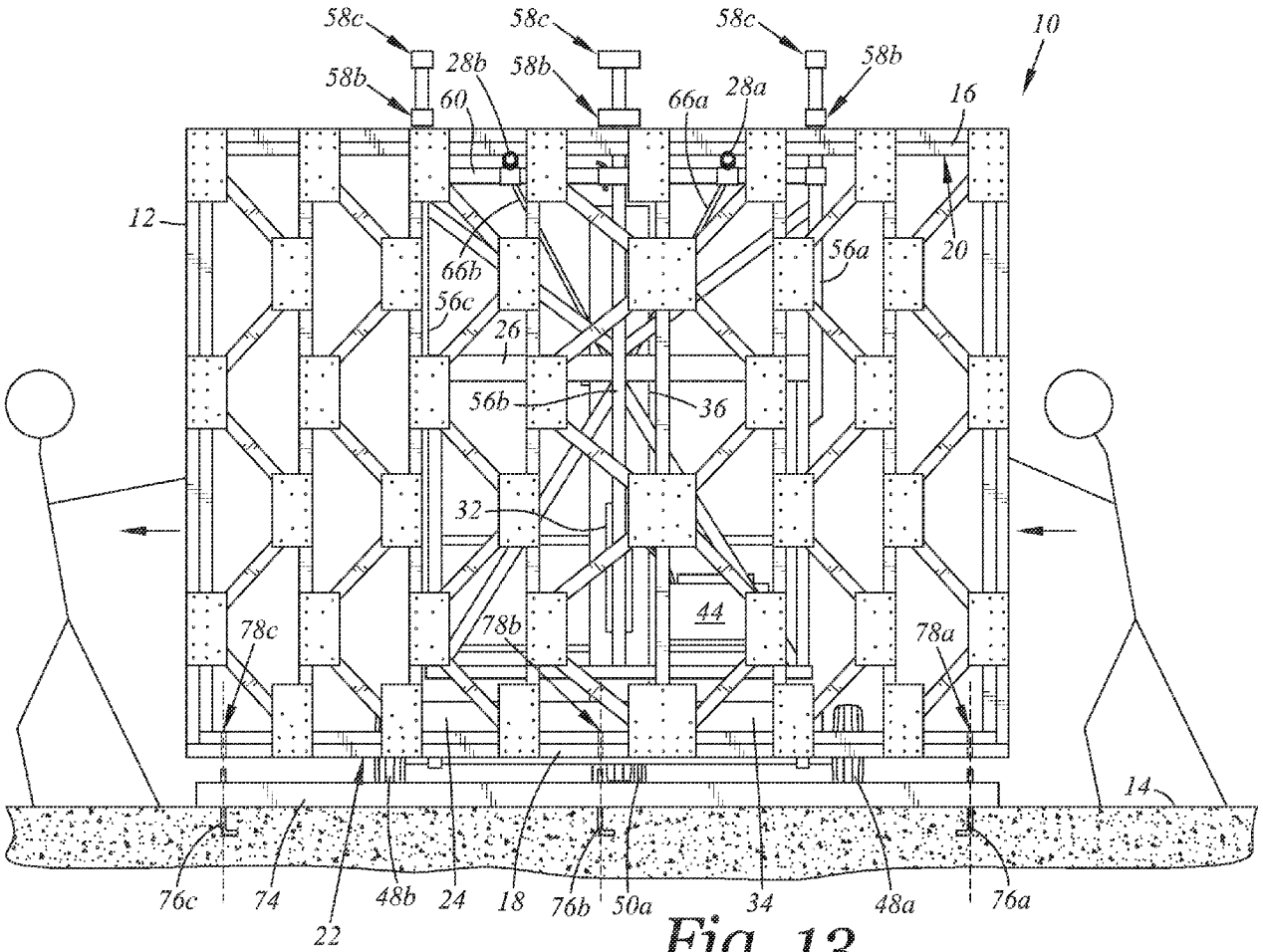
FIG. 13 is an end view of the device of FIG. 12 with the wall section with the bolt holes of the wall section aligned with the anchor bolts.

FIG. 13 is an end view of the device of FIG. 12 with the wall section 12 with the bolt holes 78*a-c* of the wall section 12 aligned with the anchor bolts 76*a-c*. The method further includes translating the wall section 12 with the lower top plate side 20 rolling along the roller pins 28*a,c*. The method may include aligning the anchor bolt holes 78*a-c* with the anchor bolts 76*a-c*. In the view of FIG. 13, the wall section 12 may be laterally moved from right to left.

Figure 9:
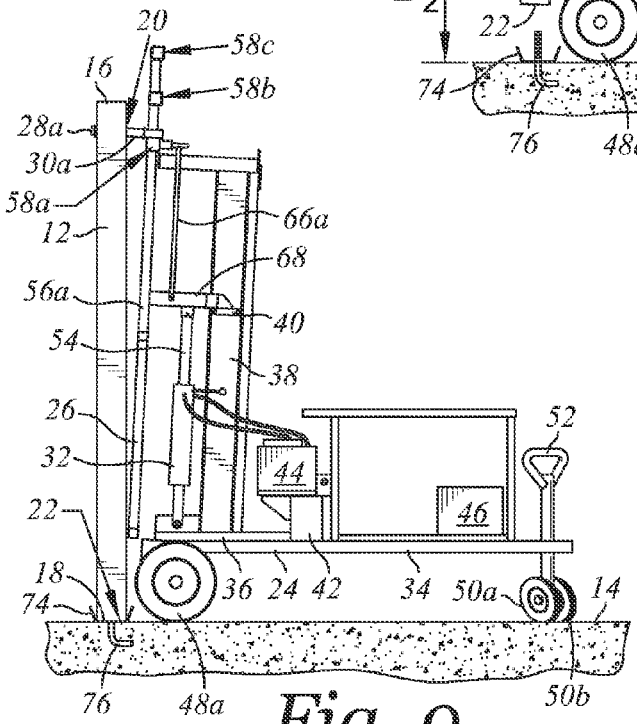
FIG. 9 is the side view of the device of FIG. 8 with the wall section positioned in the foundation U-channel and the anchor bolts engaged with the wall section.

Referring now to FIG. 9, the method includes lowering the wall section 12 with the bottom plate 18 disposed in the foundation U-channel 74 by actuating the lifting actuator 32. The lifting actuator 32 may be actuated to move the support frame 26 and the supported wall section 12 in a downward direction. The method may include lowering the wall section 12 with the anchor bolts 76*a-c* extending into the anchor bolt holes 78*a-c*. Lastly, the method may further include tilting the wall section 12 to a vertical position by lifting the top plate off 16 of the roller pins 28*a,b* with the bottom plate 18 remaining disposed in the foundation U-channel 74.

Figure 14:
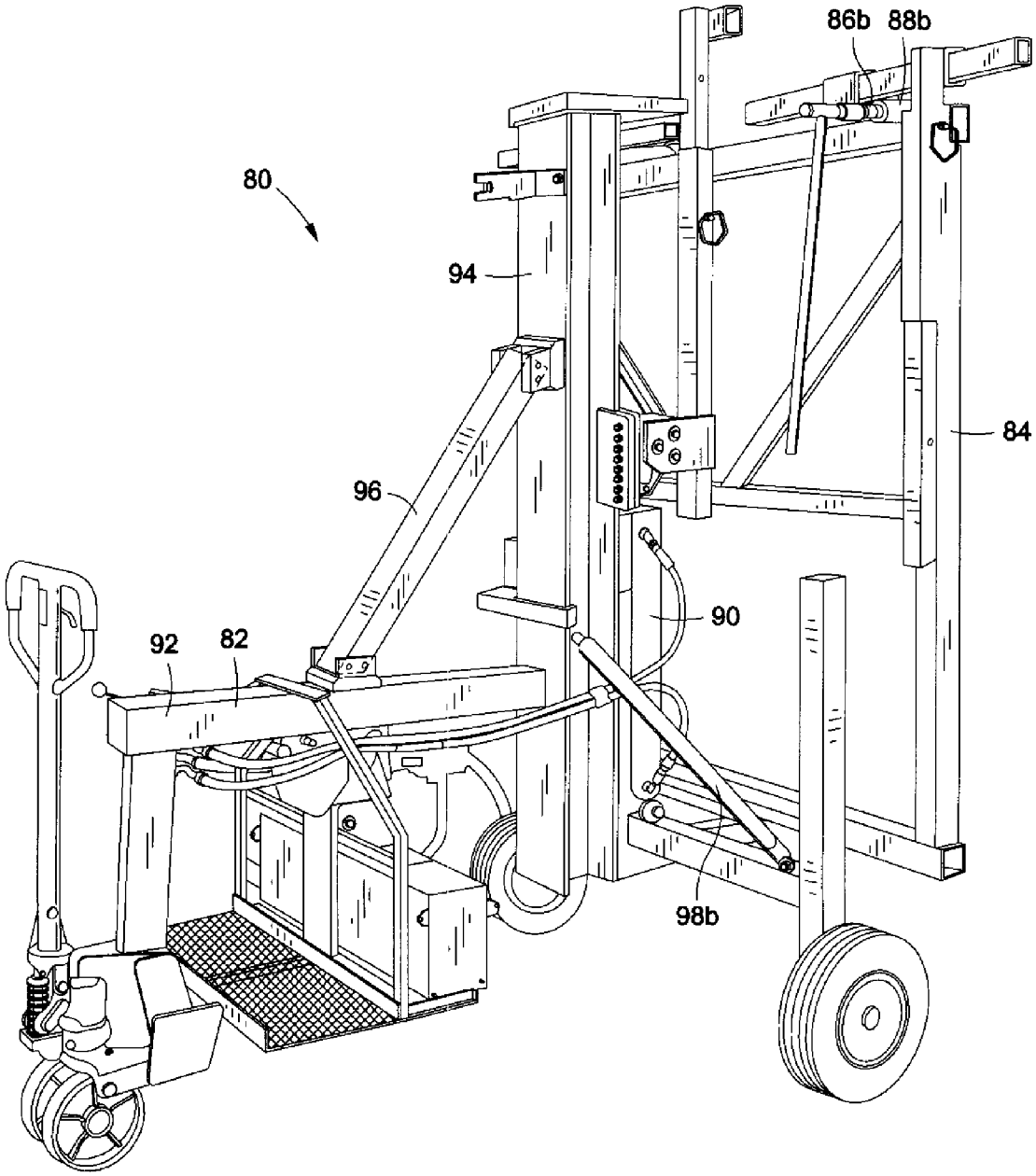
FIG. 14 is a side perspective view of a wall lifting, transport and positioning device according to another embodiment according to an aspect of the invention.

Referring now to FIG. 14, there is depicted an exploded perspective view of a portion of a wall lifting device 80 according to another embodiment similar to the wall lifting device 10. Thus, similar identified structures are as described above but with those differences noted and/or depicted. In this embodiment, there is provided the wall lifting device 80 that includes a wheeled hand cart housing 82, a support frame 84, roller pins 86*a,b* (86*a* not depicted in this view), outer cylindrical elements 88*a,b* (88*a* not depicted in this view), a lifting actuator 90, a housing frame 92 and a main support base 94. In this regard, the wheeled hand cart housing 82, the support frame 84, the roller pins 86*a,b*, the outer cylindrical elements 88*a,b*, the lifting actuator 90, the housing frame 92 and the main support base 94 are configured to perform the general functionality of respectively the wheeled hand cart housing 24, the support frame 26, the roller pins 28*a,b*, the outer cylindrical elements 30*a,b*, the lifting actuator 32, the housing frame 34 and the main support base 36 as described above in the context of the device 10.

In the embodiment of the device 80, a support brace 96 is provided that is angularly disposed and connected to the housing frame 92 and the main support base 94. The support brace 96 is disposed away from the support frame 84 in a plane generally perpendicular to that of the support frame 84. It is contemplated that the main support base 94 is a generally elongate vertical element. As such, the support brace 96 is used to structurally support and securely connect the main support base 94 to the housing frame 92. The device 80 further includes wing braces 98*a,b* (98*a* not depicted in this view). The wing braces 98 respectively extend laterally from the main support base 94 and connect to the housing frame 92. Like the support brace 96, the wing braces 98 are used to structurally support and securely connect the main support base 94 to the housing frame 92.

The particulars shown herein are by way of example and for purposes of illustrative discussion of the embodiments of the present invention only and are presented in the cause of providing what is believed to be the most useful and readily understood description of the principles and conceptual aspects. In this regard, no attempt is made to show more details than is necessary for a fundamental understanding of the disclosure, the description taken with the drawings making apparent to those skilled in the art how the several forms of the presently disclosed invention may be embodied in practice.

What is claimed is:

1. A wall lifting, transport and positioning device for use with a wall section upon a worksite surface, the wall section being rectangular and having a horizontal top plate and an opposing horizontal bottom plate, the top plate having a lower top plate side facing towards the bottom plate, the bottom plate having a lower bottom plate side facing away from the top plate, the lower top plate side and the lower bottom plate side defining a lifting wall height there between, the device comprising:

a wheeled hand cart housing;

a support frame;

a pair of roller pins extending from the support frame away from the wheeled hand cart housing, the roller pins being horizontally aligned, the roller pins positionable at least the lifting wall height above the worksite surface, each of the roller pins including an outer cylindrical element configured to rotate relative to the support frame with the lower top plate side being positioned in contact with the outer cylindrical element for translation of the wall section in a direction along the top plate, the roller pins being removeably attached to the support frame and attachable at varying heights along the support frame; and a lifting actuator disposed between the wheeled hand cart housing and the support frame, the lifting actuator being sized and configured to translate the roller pins upward relative to the wheeled hand cart housing with the outer cylindrical elements being positionable under and in contact with the lower top plate side.

2. The device of claim 1 wherein the lifting actuator and the support frame are cooperatively sized and configured to translate the roller pins upward relative to the wheeled hand cart housing with the outer cylindrical elements being positionable under and in contact with the lower top plate side and the wall section being laterally supported by support frame.

3. The device of claim 1 wherein the support frame is generally planar.

4. The device of claim 1 wherein the support frame is disposed at an angle with respect to the vertical plane with the cart housing disposed upon the worksite surface.

5. The device of claim 4 wherein the support frame is disposed generally at an 8 degree angle with respect to the vertical plane with the cart housing disposed upon the worksite surface.

6. The device of claim 5 wherein the support frame is disposed generally at an angle between 5 degrees and 20 degrees with respect to the vertical plane with the cart housing disposed upon the worksite surface.

7. The device of claim 1 wherein the lifting actuator is a hydraulic device.

8. The device of claim 1 wherein the lifting actuator includes a cylinder that is configured to move relative to the wheeled hand cart housing.

9. The device of claim 1 wherein the wheeled hand cart housing includes a housing frame and a main support base, the lifting actuator is disposed between the main support base and the support frame.

10. The device of claim 9 wherein the wheeled hand cart housing further includes a support brace disposed between and connected to the housing frame and the main support base, the support brace is disposed away from the support frame in a plane generally perpendicular to a plane of the support frame.

11. The device of claim 9 wherein the wheeled hand cart housing further includes a pair of wing braces disposed between and connected to the housing frame and the main support base, the wing braces respectively extend laterally from the main support base.

12. A method of positioning a wall section within a foundation U-channel, the wall section being rectangular and having a horizontal top plate and an opposing horizontal bottom plate, the top plate having a lower top plate side facing towards the bottom plate, the bottom plate having a lower bottom plate side facing away from the top plate, the method comprising:

a) moving a wall lifting, transport and positioning device upon a worksite surface adjacent the wall section, the wall section being disposed in a horizontal position, the device including a wheeled hand cart housing, a support frame, a pair of roller pins extending from the support frame away from the wheeled hand cart housing, and a lifting actuator disposed between the wheeled hand cart housing and the support frame, the lifting actuator being sized and configured to translate the roller pins upward relative to the wheeled hand cart housing;

b) tilting the wall section to position the lower top plate side above the pair of roller pins;

c) lifting the wall section off of the worksite surface by actuating the lifting actuator;

d) moving the device along the worksite surface to position the bottom plate above and along the foundation U-channel;

e) translating the wall section with the lower top plate side rolling along the roller pins; and f) lowering the wall section with the bottom plate disposed in the foundation U-channel by actuating the lifting actuator.

13. The method of claim 12 wherein the step b) first includes:

lifting the top plate to move the wall section from the horizontal position to a vertical position with the bottom plate disposed adjacent a worksite surface and the top plate disposed above with bottom plate.

14. The method of claim 12 wherein the foundation U-channel has a side wall defining a side wall height, and step c) includes:

lifting the wall section off of the worksite surface at least the side wall height.

15. The method of claim 12 wherein the bottom plate includes a plurality of anchor bolt holes and a plurality of anchor bolts vertically extend from within the foundation U-channel, the step e) further includes:

aligning the anchor bolt holes with anchor bolts.

16. The method of claim 15 wherein step f) includes:

lowering the wall section with the anchor bolts extending into the anchor bolt holes.

17. The method of claim 12 further includes:

g) tilting the wall section to a vertical position by lifting the top plate off of the roller pins with the bottom plate remaining disposed in the foundation U-channel.

* * * * *